US008090278B2

(12) United States Patent
Yamane

(10) Patent No.: US 8,090,278 B2
(45) Date of Patent: Jan. 3, 2012

(54) IMAGE FORMING APPARATUS HAVING AN IMAGE BEARING BODY

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 355 days.

(21) Appl. No.: 12/385,050

(22) Filed: Mar. 30, 2009

(65) Prior Publication Data

US 2009/0252508 A1 Oct. 8, 2009

(30) Foreign Application Priority Data

Apr. 4, 2008 (JP) ..... 2008-097785

(51) Int. Cl.
*G03G 15/00* (2006.01)
*G03G 15/08* (2006.01)

(52) U.S. Cl. ..... 399/43; 399/71; 399/257

(58) Field of Classification Search ..... 399/53, 399/71, 257, 44, 43, 27
See application file for complete search history.

(56) References Cited

U.S. PATENT DOCUMENTS

2003/0123907 A1* 7/2003 Nonaka et al. ..... 399/257
2007/0104499 A1* 5/2007 Ariizumi et al. ..... 399/27
2008/0240764 A1* 10/2008 Yamane ..... 399/71

FOREIGN PATENT DOCUMENTS

| | | |
|---|---|---|
| JP | 2004-045481 | 2/2004 |
| JP | 2004-125829 | 4/2004 |
| JP | 2007-133122 | 5/2007 |
| JP | 2007-147780 | 6/2007 |

OTHER PUBLICATIONS

Machine translation of JP 2007-147780 A dated May 16, 2011.*

* cited by examiner

*Primary Examiner* — Sophia S Chen
(74) *Attorney, Agent, or Firm* — Rabin & Berdo, PC

(57) ABSTRACT

An image forming apparatus includes a process including at least a developing section and an image bearing body. A calculating section calculates a number of the dots formed on the image bearing body. A rotation calculating section calculates a number of rotations of the image bearing body for forming the number of dots on the image bearing body in accordance with the print data. A controller makes a decision to determine whether the number of dots formed on the image bearing body is larger than a first reference when the number of rotations is larger than a second reference. If the answer is YES, then the controller forms a developer image formed of dots equivalent to a difference between the first reference and the number of dots. Then, the developer image is discarded.

4 Claims, 7 Drawing Sheets

START
DETECT D1
S1
DETECT L1
S2
STORE D1
STORE L1
S3
S4
NO
DRUM STOPPED?
YES
DETECT D2
S5
DETECT L2
S6
CALCULATE
D3=D2−D1
S7
S8
NO
D3>Df?
YES
CALCULATE
L3=L2−L1
S9
DETECT TEMPERATURE
AND HUMIDITY
S10
DETERMINE GROUP OF
ENVIRONMENT
S11
OBTAIN Lf FOR DETERMINE
ENVIRONMENT
S12
L4=Lf−L3
S13
S14
NO
L4>0?
YES
DISCARD TONER
CORRESPONDING TO L4
S15
END

START
DETECT D1
S21
DETECT T1
S22
DETECT L1
S23
STORE D1
STORE L1
STORE T1
S24
S25
NO
DRUM STOPPED?
YES
DETECT D2
S26
DETECT T2
S27
DETECT L2
S28
D3=D2−D1
S29
S30
NO
D3>Df?
YES
L3=L2−L1
S31
T3=T2−T1
S32
CALCULATE PRINT DUTY
S33
OBTAIN Lf FOR
CALCULATE PRINT DUTY
S34
L4=Lf−L3
S35
S36
NO
L4>0?
YES
DISCARD TONER
S37
END

IMAGE FORMING APPARATUS HAVING AN IMAGE BEARING BODY

BACKGROUND OF THE INVENTION

1. Field of the Invention

The present invention relates to image reading apparatuses such as electrophotographic printers and copying machines.

2. Description of the Related Art

Electrophotography is typically used in many image forming apparatuses, and includes essential steps of charging, exposing, developing, transferring and fixing. A charging unit uniformly charges the surface of an image bearing body. An exposing unit illuminates the charged surface of the image bearing body to form an electrostatic latent image. A print engine supplies a developer material to the electrostatic latent image to form a developer image. A transfer unit transfers the developer image onto a recording medium.

Deterioration of the developer material causes deterioration of printed images. For this reason, some conventional apparatuses are configured to discard the deteriorated developer material from the developer bearing body to the image bearing body and then to the outside of the image forming apparatus. JP2004-125829 discloses one such apparatus.

However, JP2004-125829 is configured to discard the deteriorated developer material when the process cartridge 100 operates in all environments including an environment in which images are not likely to deteriorate. This implies that the developer material may have been discarded more than necessary.

SUMMARY OF THE INVENTION

The present invention was made in view of the aforementioned drawbacks.

An object of the invention is to provide an image forming apparatus in which the amount of deteriorated developer material may be controlled.

Another object is to provide an image forming apparatus in which the amount of discarded developer material may be controlled on predetermined criteria.

An image forming apparatus includes a process cartridge including at least a developing section and an image bearing body. An exposing section irradiates a surface of an image bearing body with light to form dots for an electrostatic latent image on the image bearing body in accordance with print data. A developing section deposits a developer material to the electrostatic latent image. A calculating section calculates a number of the dots formed on the image bearing body. A rotation calculating section calculates a number of rotations of the image bearing body for forming the number of dots on the image bearing body in accordance with the print data. A developer discarding section removes the developer image from the image bearing body. A controller makes a decision to determine whether the number of dots formed on the image bearing body is larger than a first reference when the number of rotations is larger than a second reference. If the number of dots formed on the image bearing body is less than the first reference, the controller controls the exposing section to form a electrostatic latent image of a pattern on the image bearing body such that the electrostatic latent image of the pattern is equivalent to a difference between the first reference and the number of dots formed on the image bearing body, and then the developing section deposits the developer material to the electrostatic latent image of the pattern, and finally the developer discarding section removes the developer material deposited to the electrostatic latent image of the pattern from the image bearing body.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

{Configuration}

Figure 1:
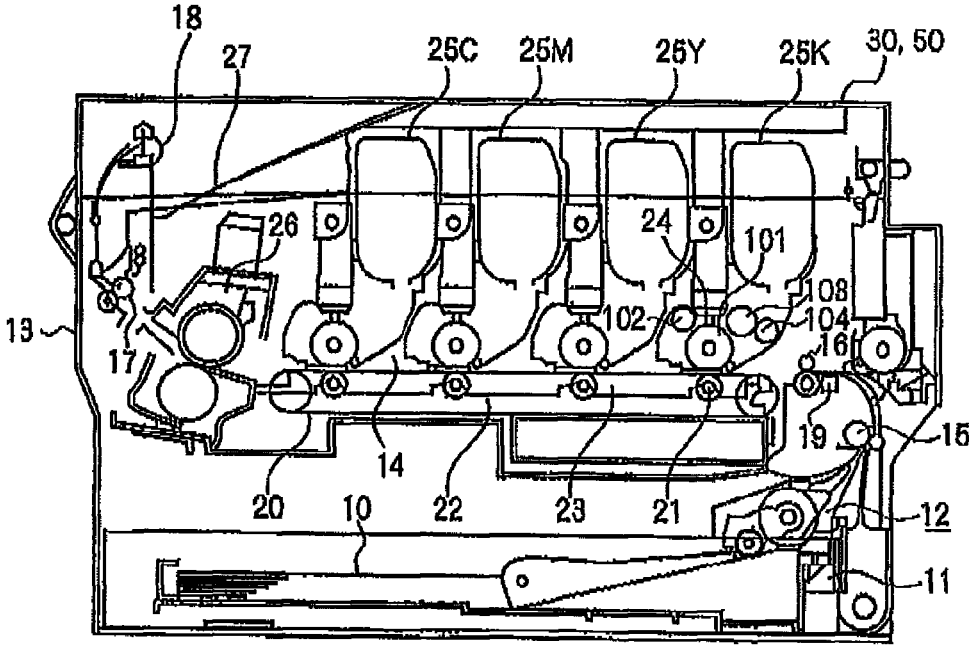
FIG. 1 illustrates the general configuration of an image forming apparatus or a printer of a first embodiment.

FIG. 1 illustrates the general configuration of an image forming apparatus or a printer 30 of a first embodiment. A paper cassette 11 holds a stack of recording media or paper 10 therein. The paper 10 is advanced from the paper cassette 11 into a transport path on a page-by-page basis. A paper advancing section 12 feeds the paper 10 from the paper cassette 11 into the transport path defined in a lower frame 13 and describing a substantially elongated "S". Transport rollers 15-18 are disposed along the transport path 14. A detector 19 detects the thickness of the paper 10 transported by the transport roller 16. A transfer belt unit 22 includes a transfer belt 20 that attracts the paper 10 electrostatically and transports the paper, and a transfer roller 21 that transfers the developer images formed in print engines 25K, 25Y, 25M, and 25C, respectively, onto the paper 10. Each print engine includes a toner container, the process cartridge 100, an exposing unit 24, and the transfer roller 21. A position adjusting mechanism 23 adjusts the position of the transfer roller 21 relative to the transfer belt 20 in accordance with the thickness of the paper 10 detected by the detector 19. The exposing units 24 of the respective the print engines 25K (black), 25Y (yellow), 25M (magenta), and 25C (cyan) each illuminate the charged surface of photoconductive drums 101 to form electrostatic latent images of the corresponding colors. The print engines 25K, 25Y, 25M, and 25C supply the developer material or toner of corresponding colors to the electrostatic latent images formed on the corresponding colors photoconductive drum 101. A fixing unit 26 fixes the developer image on the paper 10. A stacker receives the paper 10 discharged by the transport roller 18.

The paper cassette 11 holds a stack of paper 10, and is detachably attached to a lower portion of the printer 30. The paper advancing mechanism 12 is disposed above the paper cassette 11, and includes a hopping roller that separates the top sheet of the stack of paper 10.

The transport rollers 15 and 16 are disposed along the substantially S-shaped transport path 14 that extends from the paper advancing mechanism 12 to the transport roller 18. Each of the transport rollers 15 and 16 forms a roller pair with a corresponding roller, thereby transporting the paper 10 in a sandwiched relation between the rollers of the respective roller pair. A transport roller 17 is disposed immediately downstream of the fixing unit 26 and the transport roller 18 is disposed at the end of the transport path. The transport rollers 17 and 18 are driven by a drive source (not shown) in rotation to transport the paper 10. The transfer roller 17 cooperates with at least one roller to transport the paper 10 in sandwiched relation. If the printer 30 is configured to support duplex printing, the printer 30 may include a plurality of roller pairs for transporting the paper 10 in a rearward direction.

The detector 19 is disposed in the vicinity of an upstream end of the transfer belt 20, and detects the thickness of the paper 10 fed to the print engine 25K. The detector 19 may be any form of detector as long as the thickness of the paper 10 is detected accurately. The detector 19 may be implemented with, for example, a light transmission type detector or a light reflecting type detector. Information on the thickness of the paper 10 is sent to the position adjusting mechanism 23.

The transfer belt 20 is an endless belt that receives the paper 10 fed by the transport roller 16, and that electrostatically attracts the paper 10 thereto. The transfer belt 20 is disposed about a drive roller and an idle roller. The drive roller is driven in rotation by a drive mechanism (not shown). When the drive roller rotates, the idle roller is driven in rotation via the endless belt. A power supply (not shown) applies a bias voltage to the transfer roller 21, so that the transfer roller 21 transfers the developer image onto the paper 10. The transfer belt 20, drive roller, idle roller, and transfer roller 21 jointly referred to as the transfer belt unit 22.

The position adjusting mechanism 23 includes gears (not shown) by which the vertical position of the transfer belt unit 22 is adjusted relative to the photoconductive drum 101 based on the thickness information on the paper 10, detected by the detector 19.

An exposing unit 24 takes the form of an LED head that includes light emitting elements such as light emitting diodes (LEDs) and a lens array. The exposing unit 24 emits beams of light and the lens array focuses the light to form dots on the photoconductive drum 101. Each of the beams of light corresponds to a dot to be formed on the charged surface of the photoconductive drum 101. The charges in the areas on the photoconductive drum 101 illuminated by the beams are dissipated, so that the potential of the illuminated areas decreases to form an electrostatic latent image as a whole. The exposing unit 24 must be capable of forming a total of approximately 348,000 dots if the image is printed on the entire surface of A4 size paper at a resolution of 600 dpi.

The print engines 25K, 25Y, 25M, and 25C are aligned along the transfer belt 20, and are detachably attached to the printer 30. The print engines 25K, 25Y, 25M, and 25C form black, yellow, magenta, and cyan images, respectively. Each of the print engines 25K, 25Y, 25M, and 25C develops a corresponding electrostatic latent image formed on the photoconductive drum 101 into a developer image of a corresponding color.

The fixing unit 26 is disposed downstream of the print engine 25C, and fixes the full color developer image on the paper 10. The fixing unit 26 includes a heat roller, a pressure roller, a thermistor, and a heater element built in the heat roller. The heat roller includes a hollow cylinder of aluminum. The hollow cylinder is covered with a heat resistant resilient layer of silicone rubber. The heat resistant resilient layer is covered with a tube of perfluoro alkyl vinyl ether (PFA). The heater element takes the form of, for example, a halogen lamp and is built in the heat roller. The pressure roller includes a cylinder of aluminum covered with a heat resistant resilient layer of, for example, silicone rubber. The heat resistant resilient layer is covered with a tube of PFA. The pressure roller and the heat roller are in pressure contact with each other to form a nip between them. The thermistor detects the temperature of the surface of the heat roller, and is disposed in the vicinity of the heat roller but not in contact with the heat roller. Information on the temperature of the heat roller is sent to a temperature controller (not shown), which in turn controls the heater element to be energized or de-energized in accordance with the temperature information, thereby maintaining the temperature of the surface of the heat roller within a predetermined range.

The printer 30 further includes, for example, a display in the form of, for example, a liquid crystal display (LCD) and an operation section in the form of, for example, a touch panel.

{Print Engines}

A detailed description will be given of the print engines 25K, 25Y, 25M, and 25C that develop the electrostatic latent images, formed by the exposing unit 24 on the photoconductive drums, with the toner.

As described above, the print engines 25K, 25Y, 25M, and 25C form developer images of corresponding colors. The print engines 25K, 25Y, 25M, and 25C are of the same configuration and differ only in the color of developer. Each print engine includes a toner container that holds toner of a corresponding color, and a process cartridge 100 that forms a developer image using the toner supplied from the toner container, an exposing unit 24, and the transfer roller 21.

Figure 2:
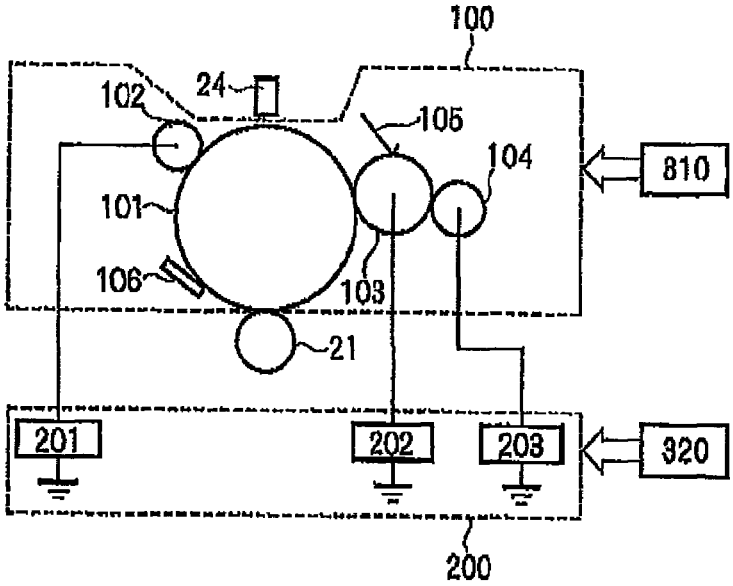
FIG. 2 illustrates a pertinent portion of a process cartridge.

FIG. 2 illustrates a pertinent portion of the process cartridge 100. A supplying roller 104 supplies the toner to a developing roller 103. A developing blade 105 forms a thin layer of toner on the developing roller 103. The supplying roller 103, developing roller 104, and developing blade 105 jointly form a developing section or a developing unit. The developing roller 103 supplies the toner to the photoconductive drum 101. The photoconductive drum 101 serves as an image bearing body. A cleaning blade 106 scrapes residual toner off the photoconductive drum 101 to clean the surface of the photoconductive drum 101.

The photoconductive drum 101 includes an electrically conductive hollow cylinder of, for example, aluminum covered with a photoconductive layer. The photoconductive layer is an organic photoconductor that includes a charge generation layer covered with a charge transport layer. The charging roller 102 uniformly charges the entire circumferential surface of the photoconductive drum 101. The exposing unit 24 illuminates the charged surface to form the electrostatic latent image on the photoconductive drum 101.

The charging roller 102 includes a metal shaft covered with a semiconductive rubber such as epichlorohydrin rubber. The charging roller 102 rotates in contact with the photoconductive drum 101, so that the charging roller 102 rotates together with the photoconductive drum 101 when the photoconductive drum 101 is driven in rotation. A charging power supply 201 applies a bias voltage of the same polarity as the toner to the charging roller 102 to uniformly charge the entire circumferential surface of the photoconductive drum 101.

The developing roller 103 includes a metal shaft covered with a semiconductive urethane rubber. The developing roller 103 is in pressure contact with the photoconductive drum 101 to form a predetermined nip therebetween, and supplies the toner to the electrostatic latent image formed on the photoconductive drum 101 to form a developer image by using a reverse development technique. A developing power supply 202 applies a bias voltage to the developing roller 103, the bias voltage being either the same polarity as the toner or an opposite polarity to the toner, so that the charged toner is deposited to the electrostatic latent image.

The toner supplying roller 104 includes a metal shaft covered with a layer of semiconductive foamed silicone sponge. The toner supplying roller 104 is in pressure contact with the developing roller 103 to form a predetermined nip therebetween, and supplies the toner to the developing roller 103. A toner supplying power supply 203 applies a bias voltage of the same polarity as the toner or of an opposite polarity to the toner to the developing roller 103, thereby supplying the toner received from the toner container to the electrostatic latent image.

The developing blade 105 is a metal thin blade-like member having substantially the same length as the developing roller 103, and a thickness of, for example, 0.08 mm, and extends parallel to the developing roller 103. The developing blade 105 has one widthwise end portion fixed to a frame (not shown) and another widthwise end portion in contact with the circumferential surface of the developing roller 103.

The cleaning blade 106 is formed of urethane rubber, and is in contact with the circumferential surface of the photoconductive drum 101. The cleaning blade 106 scrapes the residual toner off the photoconductive drum 101 to clean the circumferential surface of the photoconductive drum 101 after transfer of the developer image.

The aforementioned various rotating structural members of the process cartridge 100 are controlled by a print controller 310. For example, the photoconductive drum 101 rotates at a predetermined circumferential speed under control of the print controller 310.

A high voltage power supply 200 includes the charging power supply 201, developing power supply 202, and supplying power supply 203, and supplies various high bias voltages to the corresponding rotating members under control of a high voltage controller 320.

{Operation of Printer}

Figure 3:
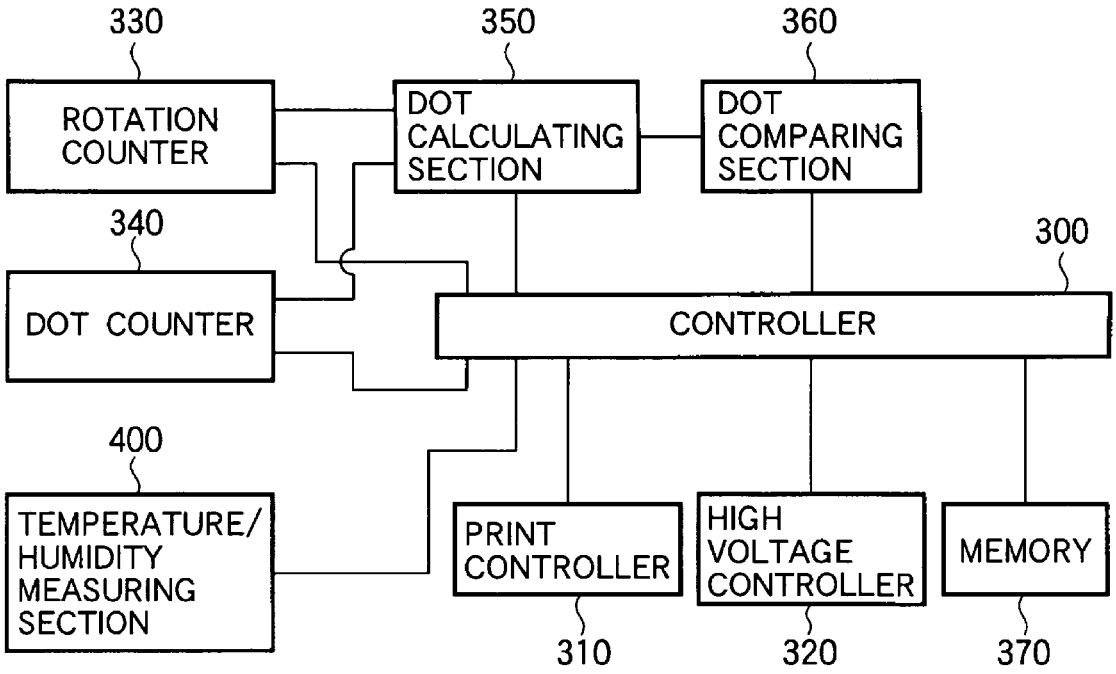
FIG. 3 is a functional block diagram illustrating a pertinent portion of the printer involved in the control of the printer.

FIG. 3 is a functional block diagram illustrating a pertinent portion of the printer 30 involved in the control of the printer 30. The control of the operation of the printer 30 of the aforementioned configuration will be described with reference to FIG. 3.

The printer 30 includes a controller 300, the print controller 310, the high voltage controller 320, a rotation counter 330, a dot counter 340, a number-of-dots calculating section 350, a dot comparing section 360, a memory 370, and a temperature/humidity measuring section 400.

The controller 300 controls the overall operation of the printer 30. The print controller 310 controls the rotation of the respective rollers in the process cartridge 100. The high voltage controller 320 controls the charging power supply 201, developing power supply 202, and supplying power supply 203 to turn on and off, and to set their output voltages. The rotation counter 330 counts the cumulative number of rotations of the photoconductive drum 101 since a new, unused process cartridge 100 has been attached to the printer 30. The dot counter 340 counts the cumulative number of dots formed on the photoconductive drum 101 by the exposing unit 24 since a new, unused process cartridge 100 has been attached to the printer 30. The number-of-dots calculating section 350 calculates the number of dots formed on the photoconductive drum per a predetermined number of rotations of the photoconductive drum based on the output of the rotation counter 330 and the output of the dot counter 340. The dot comparing section 360 compares the output of the number-of-dots calculating section 350 with a first reference Lf i.e., the number of printed dots per a predetermined number of rotations of the photoconductive drum 101. The dot comparing section 360 outputs the comparison result to the controller 300. The memory 370 stores a variety of settings including a second reference or the number of printed dots per a predetermined number of rotations (DO of the photoconductive drum 101. The temperature/humidity measuring section 400 receives information on a temperature and a humidity from a temperature/humidity detecting means (not shown) that detects the temperature and humidity of the air surrounding the process cartridge 100 inside of the printer 30, and outputs the information on the temperature and humidity to the controller 300.

The controller 300, print controller 310, high voltage controller 320, rotation counter 330, dot counter 340, number-of-dots calculating section 350, dot comparing section 360, and temperature/humidity measuring section 400 are implemented in software program resident in the printer 30. These programs may be stored in various types of memories including a volatile memory, a non-volatile memory such as a read only memory (ROM), a rewritable memory such as a flash memory, and a magnetic storage medium such as a hard disk drive. These programs are executed by a central processing unit (CPU) (not shown) of the controller 300.

The memory 370 stores various settings including the number of dots per a predetermined number of rotations, Df, of the photoconductive drum 101. The memory 370 may be implemented with, for example, a volatile memory, a non-volatile rewritable memory such as a flash memory, or a magnetic storage medium such as a hard disk drive.

{Printing Operation}

The printing operation of the printer 30 of the aforementioned configuration will be described. Upon receiving print data and a command to initiate printing, the controller 300 sends a command to the print controller 310, commanding the print controller 310 to drive the rollers of the process cartridge 100 into rotation. In response to the command, the print controller 310 drives the rollers including the photoconductive drum 101 into rotation. At the same time, the controller 300 sends a command to the high voltage controller 320, commanding the high voltage controller 320 to apply bias voltages to the respective rollers including the charging roller 102. In response to the command from the controller 300, the high voltage controller 320 controls the high voltage power supply 200 so that the power supplies 201, 202, and 203 output their corresponding bias voltages.

The photoconductive drum 101 and the charging roller 102 start to rotate under control of the print controller 310, so that the charging roller 102 charges the surface of the photoconductive drum 101 to a predetermined potential of a predetermined polarity. The developing roller 103 also starts to rotate under control of the print controller 310, and receives the toner from the toner supplying roller 104. The developing blade 105 forms a thin layer of toner on the developing roller 103. The toner on the developing roller 103 is supplied to the photoconductive drum 101 as the developing roller 103 rotate in contact with the photoconductive drum 101.

The controller 300 sends the received print data to a write controller (not shown). The write controller converts the print data into image data, and controls the exposing unit 24 to illuminate the charged surface of the photoconductive drum 101 in accordance with the image data to form an electrostatic latent image.

The developing roller 103 receives the bias voltage from the developing power supply 202, and deposits the toner to the electrostatic latent image to form a developer image.

The transfer roller 21 receives a bias voltage from a high voltage power supply (not shown), and transfers the developer images from the photoconductive drums 101 onto the paper 10 passing through the print engines 25K, 25Y, 25M, and 25C. Then, the paper 10 advances to the fixing unit 26 where the paper 10 passes through a fixing point defined between the heat roller and the pressure roller. Thus, the developing image is fixed by heat and pressure.

After fixing, the paper 10 is further advanced along the transport path. The transport roller 18 discharges the paper 10 onto the stacker 27.

The cleaning blade 106 removes the toner and paper particles left on the photoconductive drum 101 after transfer. If print data to be printed is in queue, the cleaned surface of the photoconductive drum 106 is again charged by the charging roller 102 before forming the next image. The aforementioned operation is repeated until all of the image data has been printed. If no print data is left in queue, the controller 300 sends a command to the print controller 310, commanding the print controller 310 to stop the respective rollers in the process cartridge 100. In response to the command, the print controller 310 controls the photoconductive drum 101 and the rollers to stop rotating. At the same time, the controller 300 sends a command to the high voltage controller 320, commanding the high voltage controller 320 to stop outputting the bias voltages to the photoconductive drum 101 and rollers. In response to the command, the high voltage controller 320 controls the high voltage power supply 200 to stop outputting the bias voltages to the rollers. This completes the printing operation.

The toner is charged triboelectrically by the friction between the developing roller 103 and the supplying roller 104, the friction between the developing roller 103 and the developing blade 105, and the friction between the developing roller 103 and the photoconductive drum 101. The potential of the triboelectrically charged toner decreases in an environment of high-temperature and high-humidity in which the electrical resistance of the developing roller 103 and supplying roller 104 decreases. In contrast, the potential of the toner increases in an environment of low-temperature and low-humidity.

Figure 4:
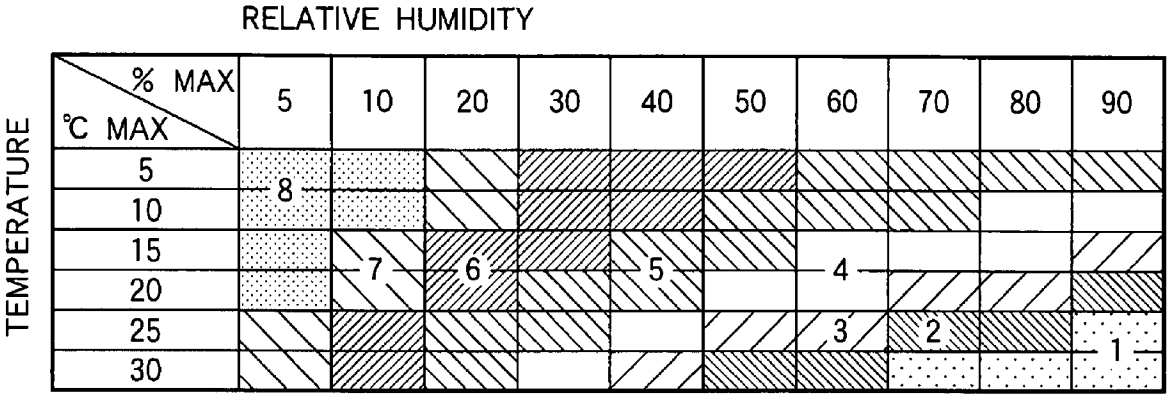
FIG. 4 illustrates 8 different groups of environment in which the process cartridge operates.
Figure 5:
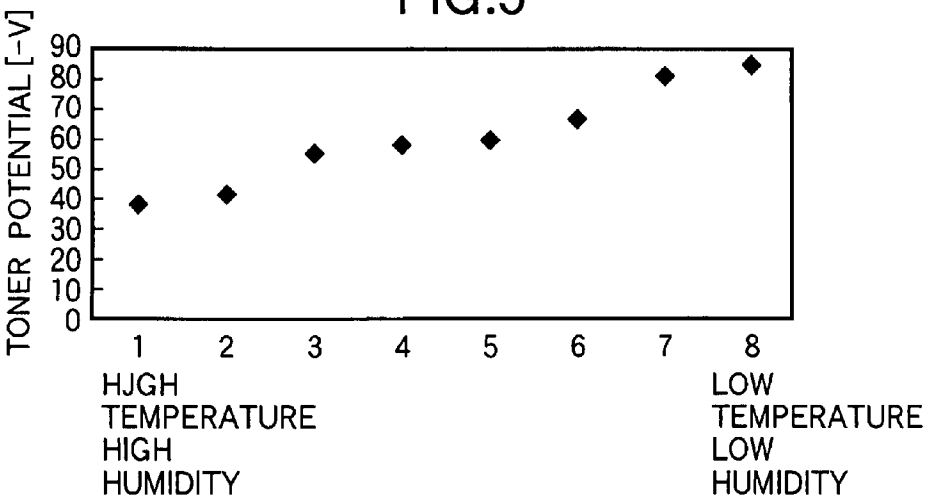
FIG. 5 illustrates the relationship between toner potential and environmental conditions.

For example, FIG. 4 plots relative humidity (RH) as the abscissa and temperature as the ordinate, and illustrates 8 different groups of environment in which the process cartridge 100 operates. Each group includes environments having a plurality of sets of temperature and relative humidity. The toner potential exhibits different values for 8 different groups of environment. FIG. 5 illustrates the toner potentials immediately after printing on 1000 pages of A4 size paper in 8 different groups of environment. Referring to FIG. 5, the toner potential is approximately −40 V in GROUP #1 (high-temperature and high humidity) and −85 V in GROUP #8 (low-temperature and low humidity). FIG. 5 reveals that a large amount of toner is excessively charged in an environment of low-temperature and low-humidity. The excessively charged toner adheres to the paper 10 causing soiling of the paper 10. This may cause poor print quality. Thus, a small amount of toner should be discarded when the process cartridge 100 operates in an environment of high-temperature and high humidity and a larger amount of toner should be discarded when the process cartridge 100 operates in an environment of low-temperature and low-humidity.

In the first embodiment, if the number of dots formed per a predetermined number of rotations of the photoconductive drum 101 is lower than a value Lf which has been assigned to an environment of interest, then an electrostatic latent image for discarding the toner is formed on the photoconductive drum 101, thereby discarding the excessively charged toner. This ensures that a small amount of toner is discarded when the process cartridge 100 operates in an environment of high-temperature and high-humidity and a large amount of toner is discarded when the process cartridge 100 operates in an environment of low-temperature and low-humidity.

{Discarding Excessively Charged Toner}

Figure 6:
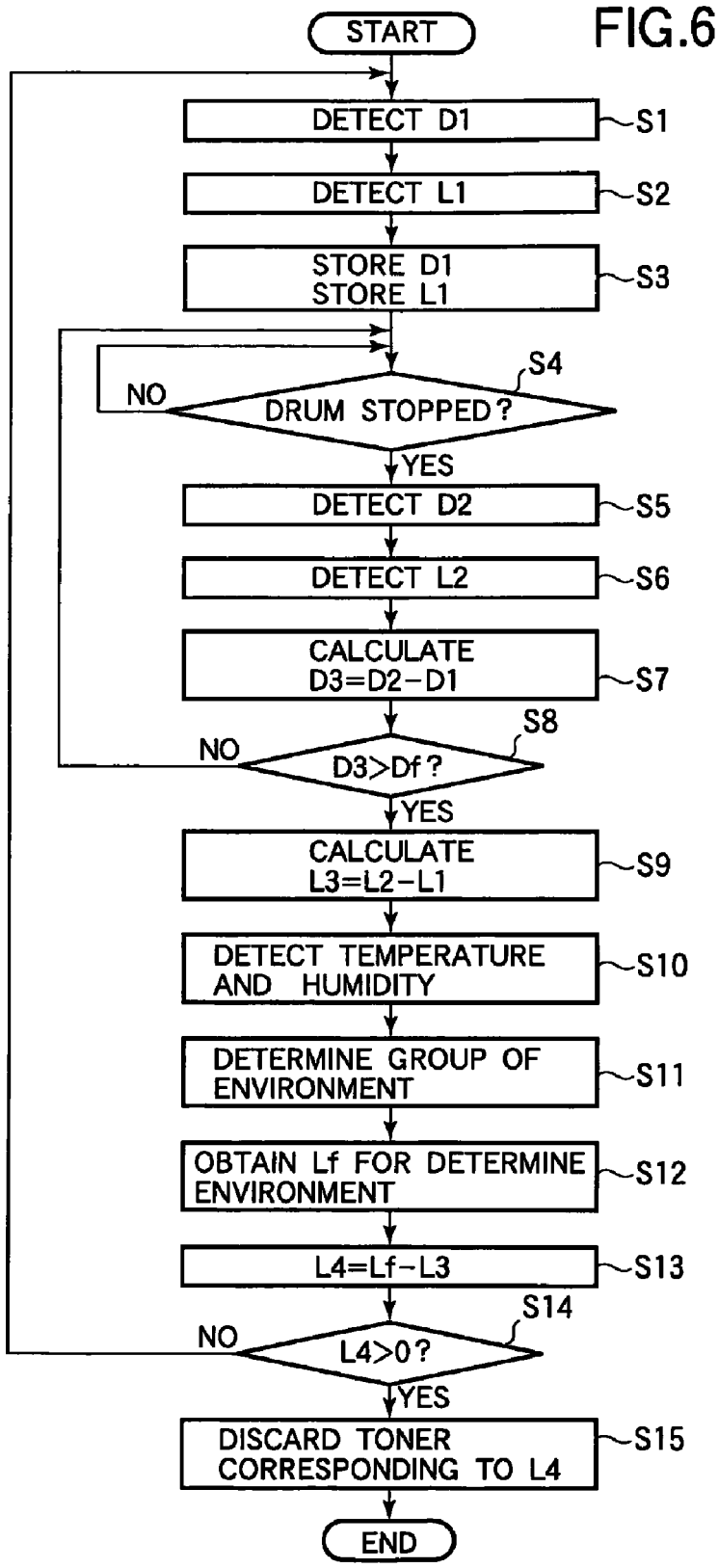
FIG. 6 is a flowchart illustrating a toner discarding operation.

FIG. 6 is a flowchart illustrating a toner discarding operation. The toner discarding operation in which excessively charged toner is discarded will be described with reference to a flowchart shown in FIG. 6. In the first embodiment, Lf is the number of printed dots per a predetermined number of rotations, Df (e.g., 90), of the photoconductive drum 101, and is a criterion or reference value based on which a decision is made to determine whether the toner should be discarded. The 8 groups of environment are assigned reference values Lf1, Lf2, Lf3, Lf4, Lf5, Lf6, Lf7, and Lf8, respectively, such that Lf1<Lf2<Lf3<Lf4<Lf5<Lf6<Lf7<Lf8. The reference values are smaller in environments of low-temperature and low-humidity and larger in environments of high-temperature and high-humidity. When the process cartridge 100 operates in an environment or one of the 8 groups of environment, the number of dots is compared with a reference Lf for the corresponding environment to determine whether the toner should be discarded.

TABLE 1

| | ENVIRONMENT GROUP | | | | | | | |
|---|---|---|---|---|---|---|---|---|
| | 1 | 2 | 3 | 4 | 5 | 6 | 7 | 8 |
| REFERENCE VALUE | Lf1 | Lf2 | Lf3 | Lf4 | Lf5 | Lf6 | Lf7 | Lf8 |

Referring to FIG. 6, at step S1, the rotation counter 330 counts the cumulative number of rotations, D1, of the photoconductive drum 101 since the process cartridge 100 has been replaced by a new, unused process cartridge 100. The cumulative number of rotations, D1, of the photoconductive drum 101 is reset to zero when a new, unused process cartridge 100 has been attached to the printer 30. For example, when printing is performed on a page of A4 size paper in portrait orientation, the photoconductive drum 101 rotates three times. Thus, the number of rotations of the photoconductive drum 101 is 3×5=15 if printing is performed on 5 pages in portrait orientation.

At step S2, the dot counter 340 counts the cumulative number of printed dots, L1. The cumulative number of printed dots, L1 is reset to zero when a new, unused process cartridge 100 has been attached to the printer 30. The controller 300 receives the cumulative number of rotations, D1 at step S1 and the cumulative number of printed dots L1 at step S2 are outputted to the controller 300, and then stores the D1 and L1 into the memory 370 at step S3. Steps S1 and S2 are executed at all times so that the memory 370 holds the most recent values of D1 and L1 immediately before any printing operation starts.

The controller 300 monitors the rotation of the photoconductive drum 101 to detect the initiation and stoppage of rotation of the photoconductive drum 101. At step S4, a check is made to determine whether the photoconductive drum 101 has stopped. When the printing operation has been completed and the photoconductive drum 101 has stopped rotating (YES at S4), the controller 300 sends a command to the rotation counter 330, commanding the rotation counter 330 to output the cumulative number of rotations D1 of the photoconductive drum 101 to the number-of-dots calculating section 350. In response to the command, the rotation counter 330 outputs the cumulative number of rotations D2 to the number-of-dots calculating section 350 (step S5).

The controller 300 sends a command to the dot counter 340, commanding the dot counter 340 to output the cumulative number of dots L2 to the number-of-dots calculating section 350. In response to the command, the dot counter 340 outputs the cumulative number of dots L2 to the number-of-dots calculating section 350 (step S6).

The number-of-dots calculating section 350 reads the D2 from the memory 370, and then calculates a difference in the number of rotations, D3, between D1 and D2, i.e., D3=D2−D1, and provides the calculated difference D3 to the controller 300 (step S7).

At step S8, the controller 300 compares the D3 with the Df stored in the memory 370. If D3>Df (YES at S8), then the controller 300 proceeds to step S9. If D3≦Df (NO at step S8) the program loops back to step S4. If the photoconductive drum 101 has stopped or the photoconductive drum 101 is rotating, the program repeats S4-S8 until D3>Df.

If D3>Df, the controller 300 controls the number-of-dots calculating section 350 to calculate a difference in the number of dots, L3, between L1 and L2, i.e., L3=L2−L1, and then causes the number-of-dots calculating section 350 to output the calculated difference L3 to the dot comparing section 360 (step S9).

The controller 300 sends a command to the temperature/humidity measuring section 400, commanding the temperature/humidity measuring section 400 to obtain the temperature and humidity of the environment inside of the printer 30 in which the process cartridge 100 operates. Then, the temperature/humidity measuring section 400 outputs information on the obtained temperature and humidity to the controller 300 (step S10).

The controller 300 refers to the memory 370, and makes a decision to determine which one of the groups of environment stored in the memory 370 corresponds to the temperature and humidity obtained from the temperature/humidity measuring section 400 (step S11).

The controller 300 selects a reference Lf corresponding to the group of environment determined at step S11, and then outputs the selected Lf to the dot comparing section 360 (step S12).

At step S13, the dot comparing section 360 calculates the difference in the number of dots, L4 (=Lf−L3), between the Lf selected by the controller 300 and the L3 calculated by the number-of-dots calculating section 350 at step S9, and then provides the difference L4 to the controller 300.

At step S14, the controller 300 makes a decision to determine whether the L4 received from the dot comparing section 360 is positive or negative. If the difference L4 is positive (YES at step 514), the program proceeds to step S15. If the difference L4 is zero or negative (NO at step S14), the program jumps back to step S1.

If the difference L4 is positive (YES at step S14), the controller 300 discards an amount of the deteriorated toner corresponding to the difference L4, and the sequence of discarding toner completes (step S15).

{Toner Discarding Sequence}

The toner discarding operation of the controller 300 will be described. Once the controller 300 decides to perform the toner discarding operation, the controller 300 sends a command to the write controller (not shown), commanding the write controller to irradiate the surface of the photoconductive drum 101 with light to form dots equal to the difference L4. The write controller then controls the exposing unit 24 to form an electrostatic latent image equivalent to the difference L4 on the surface of the photoconductive drum 101. At this moment, the LED head of the exposing unit 24 irradiates the charged surface of the photoconductive drum 101 with light to form an electrostatic latent image having a dot population density of 50%, i.e., dot area in which dots are formed are substantially equal to non-dot area in which dots are not formed, such that the dot area and the non-dot area are arranged alternately. The length of pattern of each dot in the direction of travel of the paper is adjusted, thereby irradiating the charged surface of the photoconductive drum 101 with light energy in accordance with the difference L4.

The electrostatic latent image equivalent to the difference L4 is then developed with the toner supplied from the developing roller 103 into a developer image. An amount of toner corresponding to or equivalent to the difference L4 is transferred onto the transfer belt 20 with the aid of the transfer bias voltage applied to the transfer roller 21, thereby discarding the deteriorated toner. Alternatively, the cleaning blade 106 may scrape an amount of toner equivalent to the difference L4 from the photoconductive drum 101.

As described above, the environmental conditions are grouped into 8 groups each of which includes sets of temperature and humidity. The groups have reference values Lf1 to Lf8, respectively. The number of groups is not limited to 8, and may be larger than 8. For example, as shown in Table 2, GROUPs 1 and 2 may have the same level Lf1', GROUPs 3 and 4 may have the same level Lf2', and GROUPs 7 and 8 may have the same level Lf5', in which case there are a total of five different reference values Lf1', Lf2', Lf3', Lf4', and Lf5' as shown in Table 2.

TABLE 2

| | ENVIRONMENT GROUP | | | | | | | |
|---|---|---|---|---|---|---|---|---|
| | 1 | 2 | 3 | 4 | 5 | 6 | 7 | 8 |
| REFERENCE VALUE | Lf1' | Lf1' | Lf2' | Lf2' | Lf3' | Lf4' | Lf5' | Lf5' |

Moreover, the number of reference values Lf of environment may be smaller than 5 as long as more than one reference value is employed.

As described above, the amount of toner to be discarded may be adjusted in accordance with the environment in which the process cartridge 100 operates, thus preventing the toner from being discarded more than necessary. Further, a sufficient amount of deteriorated toner may be discarded when the process cartridge 100 operates in an environment in which the excessively charged toner tends to adhere to the paper 10 to cause soiling. Thus, the quality of printed images may be maintained.

Second Embodiment

{Configuration}

The configuration of a printer 50 of a second embodiment is substantially the same as that of the printer 30 of the first embodiment. Elements similar to those of the first embodiment have been given the same reference numerals, and their description is omitted. A description will be given of only portions different from the first embodiment.

Figure 7:
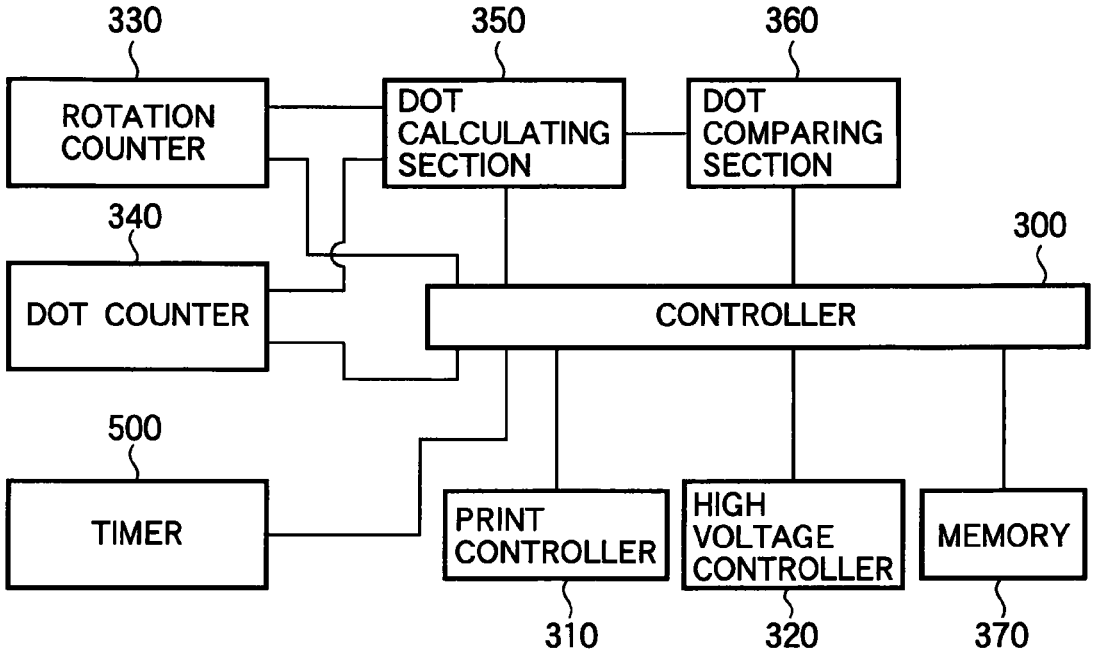
FIG. 7 is a functional block diagram illustrating a pertinent portion of a printer of a second embodiment.

FIG. 7 is a functional block diagram illustrating a pertinent portion of a printer of the second embodiment.

The printer 50 differs from the printer 30 in that a timer 500 is used in place of the temperature/humidity measuring section 400.

Generally speaking, if images of low dot population density are printed, the potential of the layer of toner formed on a developing roller 103 increases with increasing number of pages printed per unit time. This is because the amount of consumed toner is small if the number of printed dots is small as compared to the number of rotations of a photoconductive drum 101. In other words, the toner that has not been consumed yet remains between the developing roller 103 and a toner supplying roller 104, between the developing roller 103 and photoconductive drum 101, and between the developing roller and a developing blade, and is subjected to triboelectric charging. As a result, the toner is overcharged so that the toner potential increases.

Figure 8:
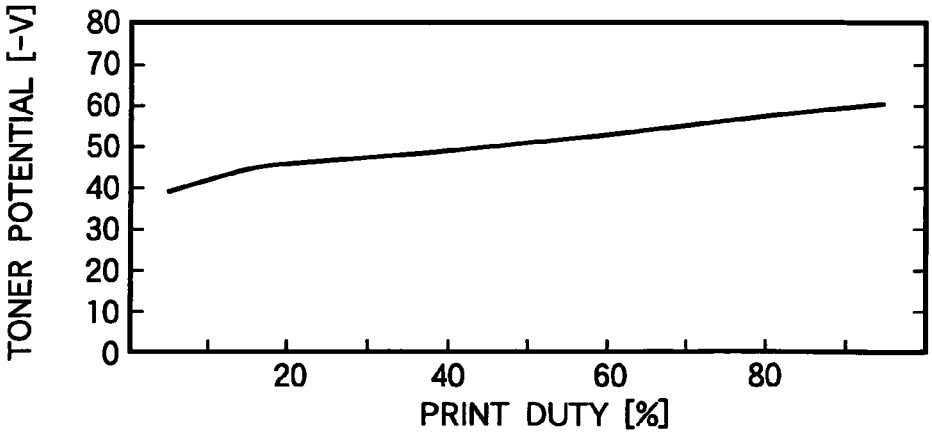
FIG. 8 illustrates the relationship between the print duty and the toner potential when an image of low dot population density is printed.

FIG. 8 illustrates the relationship between a first print duty and the potential of toner on the developing roller 103 when an image of low dot population density is printed. Print duty is defined as follows:

$$\text{Print duty}=(Pa/Pc)\times 100\% \qquad \text{Eq. (1)}$$

where Pa is the number of actually printed pages per unit time and Pc is the number of printed pages in continuous printing per unit time The unit time may be selected to, for example, 30 minutes.

For printing on a page of A4 paper in portrait orientation, the photoconductive drum 101 of the second embodiment makes three complete rotations. Thus, for example, for printing on 5 pages of A4 size paper in portrait orientation, the number of rotations, D1, of the photoconductive drum 101 is 15. In other words, the number of printed pages is proportional the number of rotations of the photoconductive drum 101. Thus, print duty may also be expressed in terms of the number of rotations of the photoconductive drum 101 as follows:

$$\text{Print duty}=(Da/T)/(Dc/T)\times 100\%. \qquad \text{Eq. (2)}$$

where T is a unit time, Da is the number of actual rotations of the photoconductive drum per unit time T, and Dc is the number of rotations of the photoconductive drum in continuous printing per unit time T and is previously known.

The unit time may be selected to, for example, 30 minutes.

The graph of FIG. 8 shows that the potential of the toner increases as the print duty increases. If the cumulative number of dots counted by the dot counter 340 is smaller than a reference Df which has been set previously for a print duty, then the toner on the developing roller 103 is discarded to the photoconductive drum 101. Thus, a larger amount of toner is discarded if an image having a smaller number of dots is printed at a high print duty.

{Toner Discarding Sequence}

Figure 9:
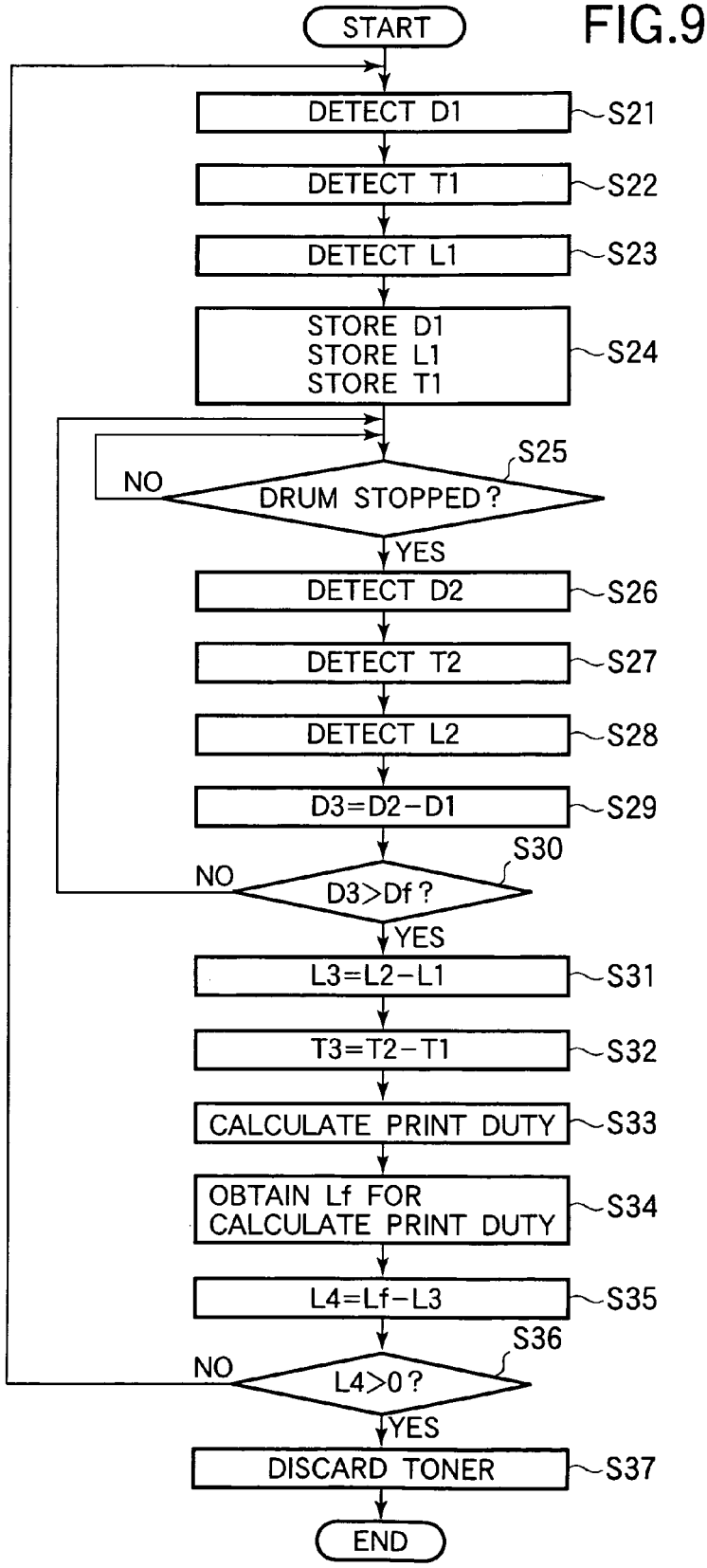
FIG. 9 is a flowchart illustrating the sequence of discarding deteriorated toner.
Figure 10:
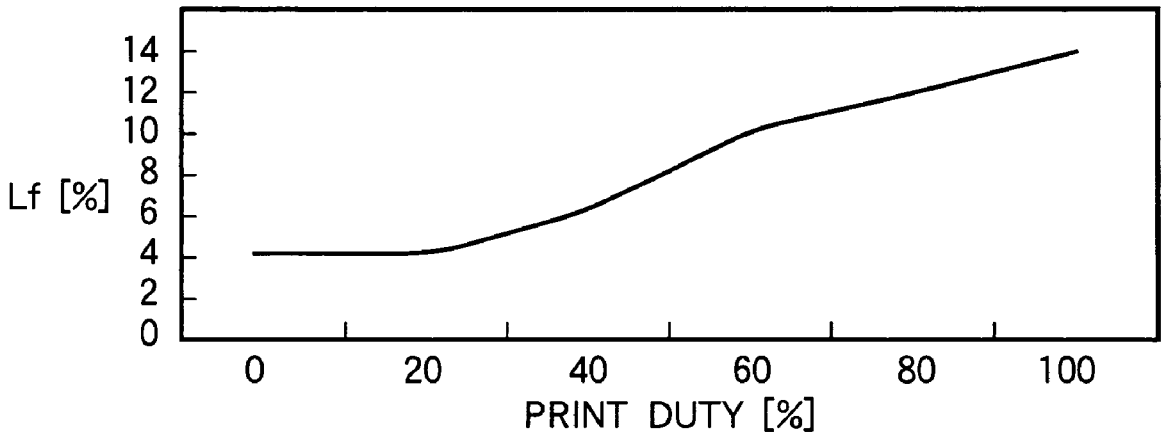
FIG. 10 illustrates the relationship between the reference value Lf and the print duty.

FIG. 9 is a flowchart illustrating the sequence of discarding deteriorated toner. FIG. 10 illustrates the relationship between the reference value Lf and the print duty.

The sequence of discarding deteriorated toner will be described with reference to the flowchart shown in FIG. 9. Assume that the decision is made based on the reference value Lf (FIG. 10) to determine whether the toner should be discarded. The reference Lf is the number of printed dots per a predetermined number of rotations of the photoconductive drum 101.

Referring to FIG. 9, at step S21, the rotation counter 330 detect the cumulative number of rotations D1 of the photoconductive drum 101 since the process cartridge 100 has been replaced by a new, unused process cartridge 100. The cumulative number of rotations D1 of the photoconductive drum 101 is reset to zero when a new, unused process cartridge 100 has been attached to the printer 30. For printing on a page of A4 paper in portrait orientation, the photoconductive drum 101 of the second embodiment makes three complete rotations. Thus, for example, for printing on 5 pages of A4 size paper in portrait orientation, the number of rotations, D1, of the photoconductive drum 101 is 15.

At step S22, the timer 500 detects time T1 at which the rotation counter 330 detects the cumulative number of rotations D1.

As step S23, the dot counter 340 detects the cumulative number of printed dots, L1. The cumulative number of printed dots, L1, is reset to zero when a new, unused process cartridge 100 has been attached to the printer 30. The D1, T1, and L1 are outputted to the controller 300. The controller 300 receives the number of rotations D1, and then stores the D1 into the memory 370. Also, the controller 300 stores the number of printed dots L1 into the memory 370 (step S24). Steps S21 to S23 are executed at all times, so that the memory 370 holds the most recent values of D1, T1, and L1 immediately before a print command is received.

The controller 300 monitors rotation of the photoconductive drum 101 to detect the beginning and ending of rotation of the photoconductive drum 101. When a printing operation has completed and the photoconductive drum 101 has stopped rotating (YES at step S25), the controller 300 sends a command to the rotation counter 330, commanding the rotation counter 330 to output the cumulative number of rotations D1 of the photoconductive drum 101 to the number-of-dots calculating section 350. In response to the command, the rotation counter 330 outputs the cumulative number of rotations D1 of the photoconductive drum 101 to the number-of-dots calculating section 356 (step S26).

The controller 300 sends a command to the timer 500, commanding the timer 500 to measure the time T2, and then to output the time T2 to the controller 300. In response to the command, the timer 500 measures the time T2 and then outputs the time T2 to the controller 300. Then, the controller 300 stores the received time T2 into the memory 370 (step S27).

The controller 300 sends a command to the dot counter 340, commanding the dot counter 340 to output the cumulative number of printed dots L1 to the number-of-dots calculating section 350. In response to the command, the dot counter 340 outputs the cumulative number of printed dots L2 to the number-of-dots calculating section 350 (step S28).

The number-of-dots calculating section 350 reads the D1 from the memory 370, and then calculates the difference D3 (=D2−D1). Then, the number-of-dots calculating section 350 outputs the D3 to the controller 300 (step S29).

Then, the controller 300 compares the D3 with Df (step S30) If the difference D3>Df (YES at step S30), the program proceeds to S31. If the difference D3≦Df (NO at S30), the program loops back to S25.

If D3>Df (YES at S30), the controller 300 sends a command to the number-of-dots calculating section 350, commanding the number-of-dots calculating section 350 to calculate L3 (=L2−L1) and to then output the calculated L3 to the dot comparing section 360. In response to the command, the number-of-dots calculating section 350 calculates the L3 and then outputs the calculated L3 to the dot comparing section 360 (step S31).

Then, at step S32, the controller 300 reads the time T1 from the memory 370, and then calculates a difference T3 between T1 and T2, i.e., T3=T2−T1.

The controller 300 calculates the print duty based on the D3 and T3 using Eq. (2) as follows:

$$\text{print duty} = (Da/T)/(Dc/T) \times 100\%$$

$$= (Da/Dc) \times 100\%$$

A print duty per unit time T3 may be calculated by putting D3 into Da and a previously known value of the number of rotations of the photoconductive drum into Dc.

The controller 300 selects the reference Lf corresponding to the print duty calculated at step S33, and outputs the selected reference Lf to the dot comparing section 360 (step S34).

At step S35, the dot comparing section 360 calculates a difference L4 (=Lf−L3), and then outputs the calculated L4 to the controller 300.

The controller 300 determines whether the L4 is positive or negative. If the L4 is positive (YES, at step S36), the program proceeds to step S37. If the L4 is negative or equal to zero (NO at step S36), the program jumps back to step S21.

If the L4 is positive (YES at step S36), the controller 300 performs the toner discarding operation for the L4, completing the toner discarding sequence (step S37).

The operation of discarding deteriorated toner will be described. Once the controller 300 decides to perform discarding of the deteriorated toner, the controller 300 sends a command to a write controller (not shown), commanding the write controller to irradiate the charged surface of the photoconductive drum 101 with light corresponding to the L4. In response to the command, the write controller controls the exposing unit 24 to form an electrostatic latent image corresponding to or equivalent to the L4 on the surface of the photoconductive drum 101. At this moment, the LED head of the exposing unit 24 irradiates the charged surface of the photoconductive drum 101 with light corresponding to the L4. In other words, the LED head of the exposing unit 24 irradiates the photoconductive drum 101 with light such that the dot areas and non-dot areas line up in the traverse direction (perpendicular to the direction of travel of the paper), the dot area and non-dot area appearing alternately to form an image having a dot population density of 50%. In this manner, the length of dot patterns in the direction of travel of the paper is adjusted in accordance with the L4.

The developing roller 103 supplies the toner to the electrostatic latent image corresponding to the L4, thereby developing the electrostatic latent image into a developer image. The toner corresponding to the L4 deposited to the photoconductive drum 101 is transferred onto the transfer belt 20 with the aid of the bias voltage applied to the transfer roller 20. Alternatively, the cleaning blade 106 may remove the toner corresponding to or equivalent to the L4 from the photoconductive drum 101, thereby discarding the deteriorated toner.

While the second embodiment has been described with respect to the reference Lf determined based on the print duty shown in FIG. 10, the second embodiment is not limited to this. For example, the print duty and the reference Lf may be related as shown in Table 3, in which case the references are related such that Lf1<Lf2<Lf3<Lf4<Lf5<Lf6.

TABLE 3

| | PRINT DUTY, r (%) | | | | | |
|---|---|---|---|---|---|---|
| | 0 ≦ r < 20 | 20 ≦ r < 40 | 40 ≦ r < 50 | 50 ≦ r < 60 | 60 ≦ r < 80 | 80 ≦ r < 100 |
| REFERENCE VALUE, Lf | Lf1 | Lf2 | Lf3 | Lf4 | Lf5 | Lf6 |

As shown in Table 4, the toner is not overcharged when the print duty is low, e.g., in the range of 0 to 20%. Therefore, the controller 300 does not determine whether the toner should be discarded, and the toner need not be discarded.

TABLE 4

| | PRINT DUTY, r (%) | | | | | |
|---|---|---|---|---|---|---|
| | 0 ≦ r < 20 | 20 ≦ r < 40 | 40 ≦ r < 50 | 50 ≦ r < 60 | 60 ≦ r < 80 | 80 ≦ r ≦ 100 |
| REFERENCE VALUE, Lf | — | Lf1' | Lf2' | Lf3' | Lf4' | Lf5' |

As shown in Table 5, when the print duty is high, e.g., in the range of 80 to 100%, the controller 300 does not determine whether the toner should be discarded, and the toner need not be discarded.

TABLE 5

| | PRINT DUTY, r (%) | | | | | |
|---|---|---|---|---|---|---|
| | 0 ≦ r < 20 | 20 ≦ r < 40 | 40 ≦ r < 50 | 50 ≦ r < 60 | 60 ≦ r < 80 | 80 ≦ r ≦ 100 |
| REFERENCE VALUE, Lf | — | Lf1" | Lf2" | Lf3" | Lf4" | — |

As described above, the amount of toner that should be discarded may be adjusted in accordance with the number of printed pages per unit time, thereby preventing the toner from being discarded more than necessary. If an image having a relatively small number of dots is printed at a high print duty, a sufficient amount of deteriorated toner may be discarded to maintain good print quality.

Although the image forming apparatus of the present invention has been described in terms of a printer, the invention may be applied to a multi function peripheral (MFP), a facsimile machine, and a copying machine.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image forming apparatus including a process cartridge including at least a developing section and an image bearing body, comprising:

an exposing section that irradiates a surface of an image bearing body with light to form dots for an electrostatic latent image on the image bearing body in accordance with print data;

a developing section that deposits a developer material to the electrostatic latent image;

a calculating section that calculates a number of the dots formed on the image bearing body;

a rotation calculating section that calculates a number of rotations of the image bearing body for forming the number of dots on the image bearing body in accordance with the print data;

a developer discarding section that removes the developer image from the image bearing body;

a controller that makes a decision to determine whether the number of dots formed on the image bearing body is larger than a first reference when the number of rotations is larger than a second reference; and a timer that detects a time during which the image bearing body rotates to form the dots for the electrostatic latent image in accordance with the print data;

wherein if the number of dots formed on the image bearing body is less than the first reference, said controller controls said exposing section to form an electrostatic latent image of a pattern on the image bearing body such that the electrostatic latent image of the pattern is equivalent to a difference between the first reference and the number of dots formed on the image bearing body, and then said developing section deposits the developer material to the electrostatic latent image of the pattern, and finally said developer discarding section removes the developer material deposited to the electrostatic latent image of the pattern from the image bearing body; and wherein said controller calculates a print duty based on the time and the number of rotations of the image bearing body in forming the dots for the electrostatic latent image in accordance with the print data, the print duty being a ratio of the number of rotations of the image bearing body per unit time to a maximum number of rotations of the image bearing body per unit time in continuous printing.

2. The image forming apparatus according to claim 1, wherein said controller changes the first reference in accordance with the print duty.

3. An image forming apparatus including a process cartridge including at least a developing section and an image bearing body, comprising:

an exposing section that irradiates a surface of an image bearing body with light to form dots for an electrostatic latent image on the image bearing body in accordance with print data;

a developing section that deposits a developer material to the electrostatic latent image;

a calculating section that calculates a number of the dots formed on the image bearing body;

a rotation calculating section that calculates a number of rotations of the image bearing body for forming the number of dots on the image bearing body in accordance with the print data;

a developer discarding section that removes the developer image from the image bearing body;

a controller that makes a decision to determine whether the number of dots formed on the image bearing body is larger than a first reference when the number of rotations is larger than a second reference; and a timer that detects a time during which the image bearing body rotates to form the dots for the electrostatic latent image in accordance with the print data;

wherein if the number of dots formed on the image bearing body is less than the first reference, said controller controls said exposing section to form an electrostatic latent image of a pattern on the image bearing body such that the electrostatic latent image of the pattern is equivalent to a difference between the first reference and the number of dots formed on the image bearing body, and then said developing section deposits the developer material to the electrostatic latin image of the pattern, and finally said developer discarding section removes the developer material deposited to the electrostatic latent image of the pattern from the image bearing body; and wherein said controller calculates a print duty based on the time and the number of rotations of the image bearing body, the print duty being a ratio of the number of actually printed pages per unit time to a maximum number of pages printable per unit time in continuous printing.

4. The image forming apparatus according to claim 3, wherein said controller changes the first reference in accordance with the print duty.

* * * * *